United States Patent [19]

Rohweller et al.

[11] Patent Number: 4,813,496

[45] Date of Patent: Mar. 21, 1989

[54] DRILL AHEAD TOOL

[75] Inventors: David J. Rohweller, Ventura, Calif.; Joseph W. Pallini, Jr., Tomball, Tex.

[73] Assignee: Vetco Gray Inc., Houston, Tex.

[21] Appl. No.: 200,890

[22] Filed: Jun. 1, 1988

[51] Int. Cl.[4] ..... E21B 7/124; E21B 7/20

[52] U.S. Cl. ..... 175/7; 166/340; 166/365; 175/107; 175/171

[58] Field of Search ..... 175/7, 6, 8, 107, 103, 175/92, 107, 171, 203, 257, 320, 321, 195; 166/358, 339, 340, 365

[56] References Cited

U.S. PATENT DOCUMENTS

| | | | |
|---|---|---|---|
| 3,262,508 | 7/1966 | Price | 175/171 X |
| 3,376,922 | 4/1968 | Leonhardt, Jr. | 166/358 |
| 3;732,143 | 5/1973 | Joosse | 175/171 X |
| 3,901,331 | 8/1975 | Djurovie | 175/171 |
| 3,973,635 | 8/1976 | Gatlin et al. | 175/7 |
| 4,759,413 | 7/1988 | Bailey et al. | 175/7 X |

*Primary Examiner*—Stephen J. Novosad
*Attorney, Agent, or Firm*—James E. Bradley

[57] ABSTRACT

A drill ahead tool for drilling the initial portion of a subsea well allows an operator to drill ahead after running conductor pipe. The running tool locates in the wellhead housing secured to the upper end of the string of conductor pipe. The running tool has a mandrel that connects into the string of drill pipe. The mandrel locates in a sleeve. The sleeve locates in a body of the running tool. The body has dogs which engage a groove in the wellhead housing to secure the running tool to the wellhead housing while the conductor pipe is being run. The sleeve has a cam on its exterior for maintaining the dogs in the extended position. The drill pipe rotates the sleeve to advance the cam to allow the dogs to be retracted. The mandrel and sleeve have a J-slot and pin that allow the mandrel to be released from the sleeve to continue drilling ahead.

3 Claims, 4 Drawing Sheets

DRILL AHEAD TOOL

BACKGROUND OF THE INVENTION

1. Field of the Invention:

This invention relates in general to equipment for drilling subsea wells from a floating vessel, and in particular to a running tool for use in drilling the initial portions of the well.

2. Description of the Prior Art:

In drilling a well in deep water, a floating vessel will be used. A template or guide base will be located on the subsea floor. When starting the well, large diameter conductor pipe, normally 30 inches in diameter, is lowered from the vessel and through a well receptacle in the template. Drill pipe extends through the conductor pipe. A drilling tool such as a drill bit and a drill mud motor will be located at the bottom of the conductor pipe. A wellhead housing is located at the upper end of the conductor pipe string. A running tool locates in the wellhead housing and supports the drill bit at the bottom of the conductor pipe.

Drilling fluid is pumped down the drill string to cause the mud motor to rotate the drill bit to drill the hole for the conductor pipe. Alternately the hole is drilled by jetting alone, without using a mud motor. As the hole deepens, the conductor pipe is lowered into the well. When at the desired depth in the well, typically about 300 feet, the wellhead housing will be located at the template. The running tool and drill bit are removed from the well. The running tool is removed from the drill string.

Then, the drill string is again lowered through the conductor pipe and used to drill the second portion of the well. This second portion is drilled to a depth of about 1,000 feet. After this portion is drilled, the drill string is pulled, and a string of casing is lowered through the conductor pipe and cemented in place. Drilling will then continue.

While this is successful, removing the drill bit from the conductor pipe, taking off the running tool, and lowering the drill bit back in to drill the second portion of the well is time consuming in deep water.

One type of running tool is used which enables the operator to drill the second portion of the well without retrieving the running tool and drill bit to the surface. That running tool has double J-slots. One J-slot secures the running tool in the wellhead housing. Another J-slot releases the drill string from the running tool to allow it to drill ahead. While workable, actuating two J-slots can be difficult with a floating vessel because of the wave action.

SUMMARY OF THE INVENTION

In this invention, the running tool has a tubular mandrel with upper and lower threaded ends connected into the string of the drill pipe. A sleeve receives the mandrel. A body receives the sleeve. The body is adapted to seat inside the wellhead housing. A plurality of dogs are carried by the body. A cam on the sleeve will move the dogs out to lock the running tool to the wellhead housing. The running tool can be released by rotating the sleeve relative to the body.

The mandrel and the sleeve are connected together through a J-slot. The J-slot releases the mandrel when the drill pipe is manipulated, to allow the drill bit to drill ahead below the conductor pipe. A locking means selectively disables the J-slot from accidental actuation.

DESCRIPTION OF THE PREFERRED EMBODIMENT

Figure 1A:
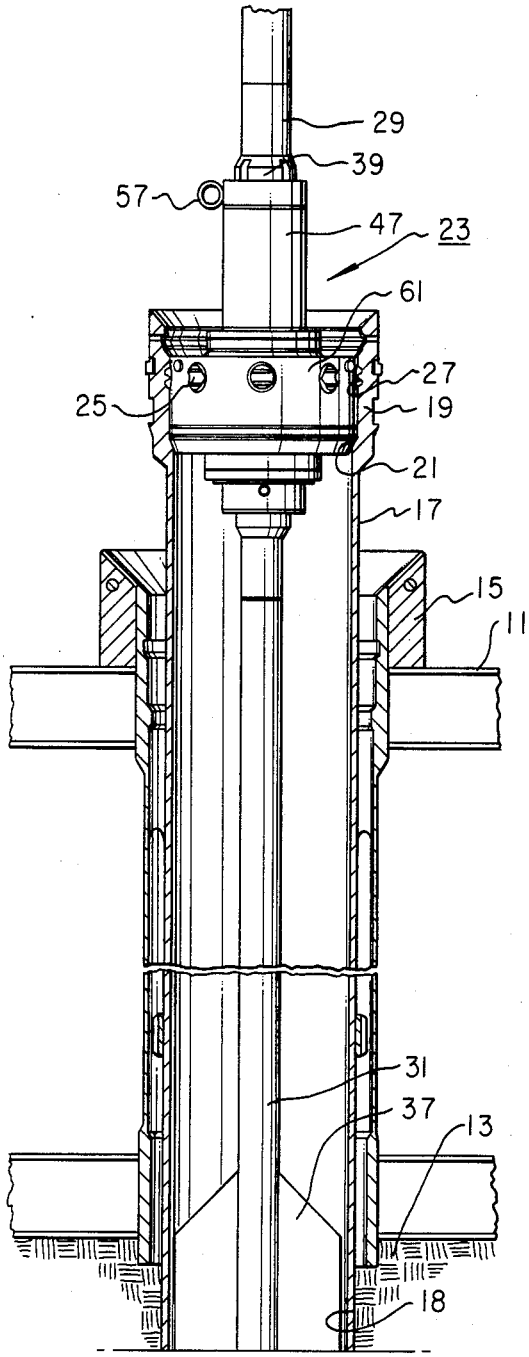
FIGS. 1*a* and 1*b* are sectional schematic views illustrating a running tool constructed in accordance with this invention, showing the running tool in the position wherein the conductor pipe is being lowered into the well as the well is being drilled.
Figure 1B:
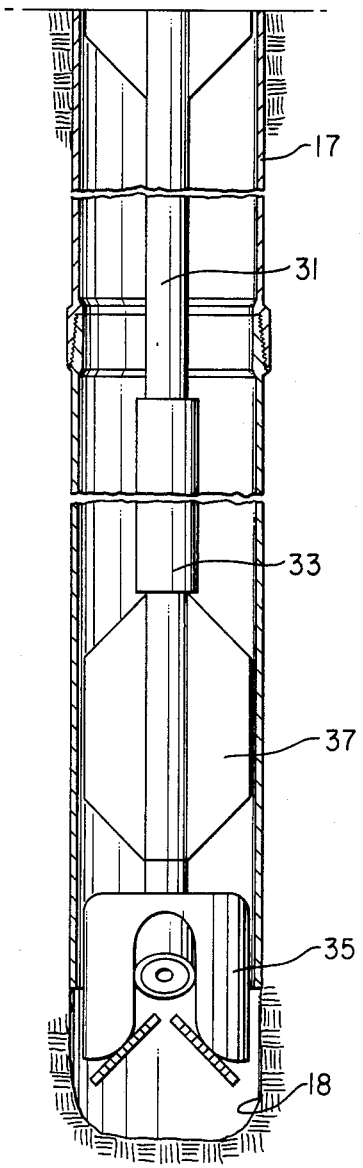

Referring to FIGS. *a* and 1*b*, a subsea template 11 will be installed on the sea floor 13. The subsea template 11 has one or more well receptacles 15. A string of conductor pipe 17 extends through the well receptacle 15 for encasing the upper portion of the well 18.

The conductor pipe 17 is made up of joints or sections of pipe screwed together, each approximately 40 feet long. A wellhead housing 19 will be secured to the upper end of the string of conductor pipe 17 as it is being lowered from a floating vessel (not shown). Wellhead housing 19 has an internal landing shoulder 21.

When running the string of conductor pipe 17, a running tool 23 will be secured in the wellhead housing 19. The running tool 23 is secured by dogs 25, which locate within grooves 27 in the interior of the wellhead housing 19. An upper string of drill pipe 29 extends from the running tool 23 to the vessel. The drill pipe 29 supports the weight of the conductor pipe 17 as it is lowered through the sea.

A lower string of drill pipe 31 extends downward from the running tool 23. The drill pipe 31 extends to the open lower end of the conductor pipe 17. A drill motor 33 may be located in the drill pipe 31 directly above a drill bit 35, which is at the lower end of the drill pipe 31.

Drilling fluid pumped down the strings 29, 31 of drill pipe causes the drill motor :33 to rotate the drill bit 35 relative to the drill pipe strings 29, 31 to drill the initial portion of the well 18. The drilling fluid is jetted out of the drill bit 35 to assist in forming the well 18. The drilling fluid flows back up the conductor pipe 17. Centralizers 37 center the drill pipe 31 in the conductor pipe 17.

Figure 3A:
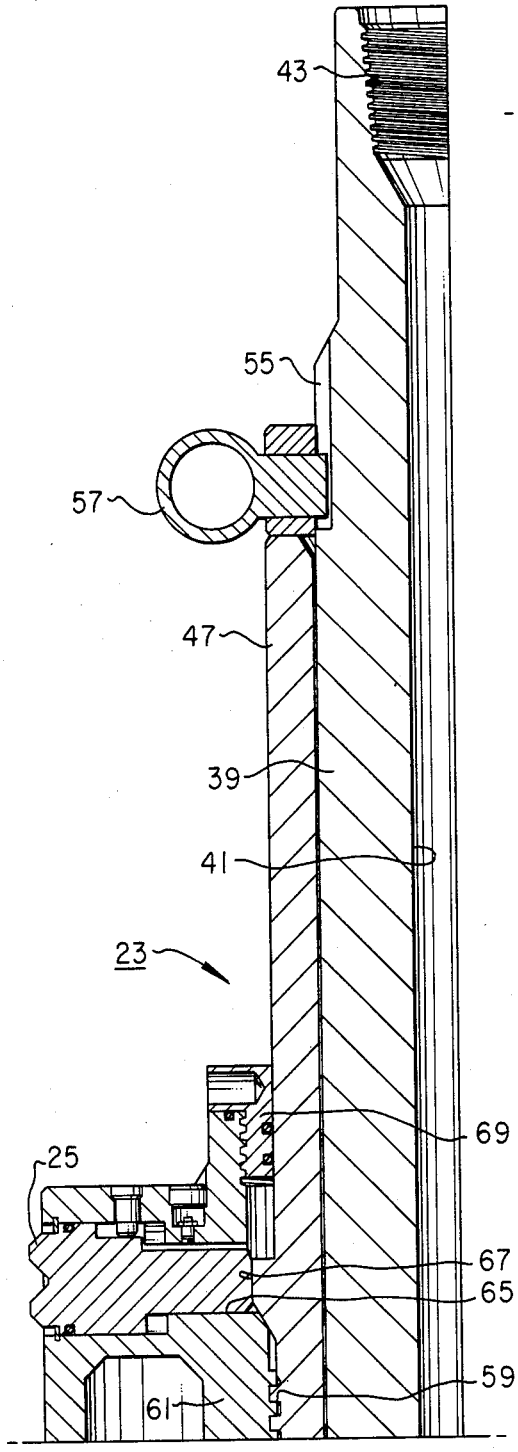
FIGS. 3*a* and 3*b* are vertical sectional views, enlarged, showing the running tool of FIGS. 1*a* and 1*b* in a locked position.
Figure 3B:
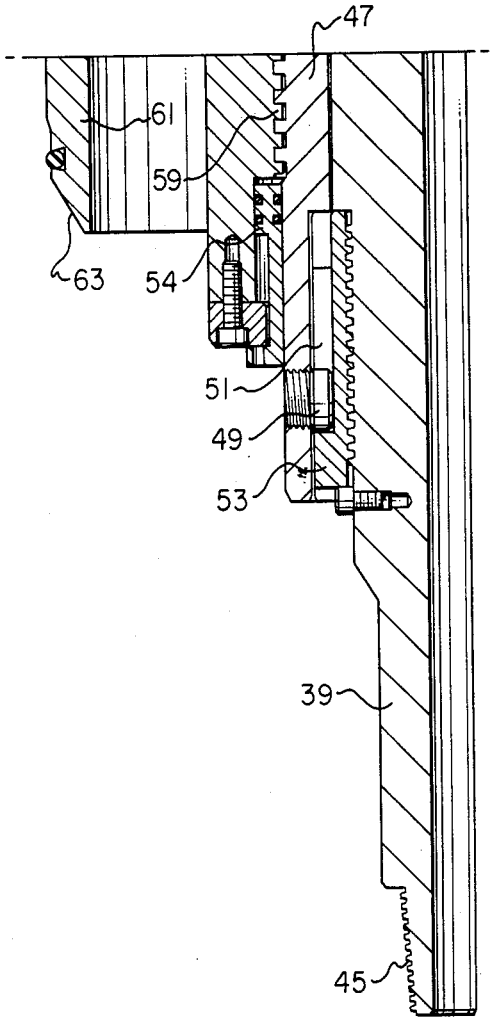

Referring to FIGS. 3*a* and 3*b*, the running tool 23 includes a tubular mandrel 39. Mandrel 39 has a cylindrical exterior and an axial passage 41 that extends through it. Upper threads 43 connect the mandrel 39 to the drill pipe 29. Lower threads 45 connect the mandrel 39 to the drill pipe 31.

Figure 2A:
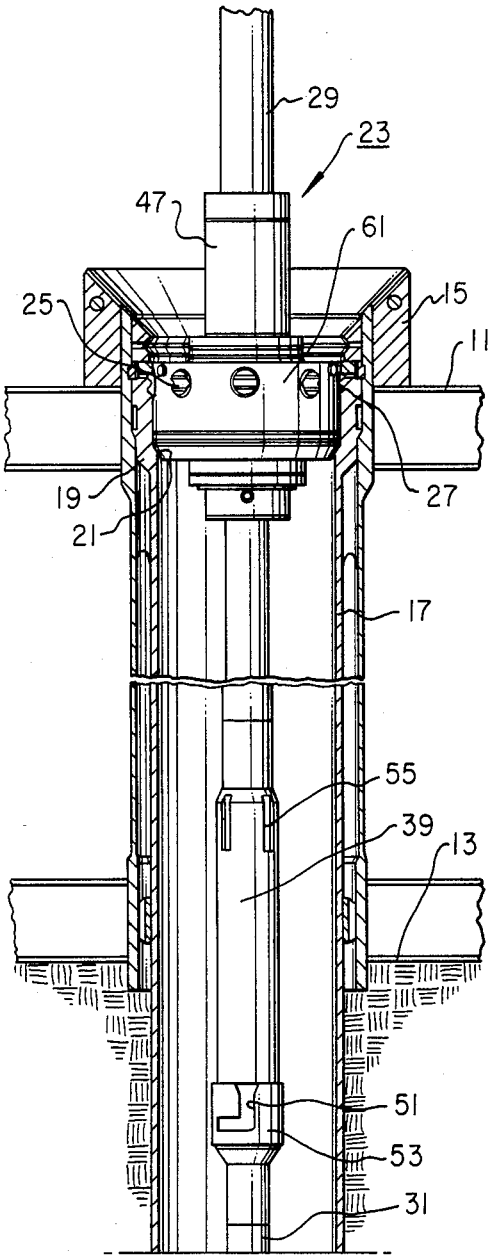
FIGS. 2*a* and 2*b* are sectional views of the running tool of FIG. 1*a* and 1*b*, showing the running tool in the position with the drilling bit drilling below the conductor pipe after the conductor pipe has reached its proper depth.
Figure 2B:
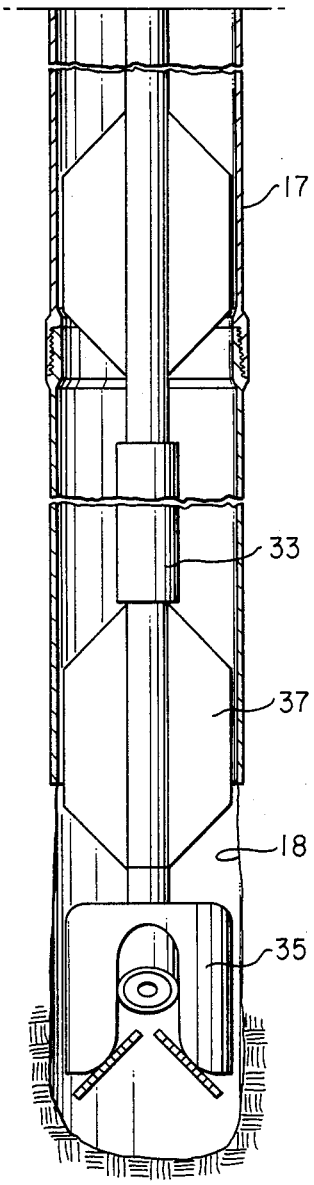

The mandrel 39 is carried inside a sleeve 47. A pin 49 secured to the sleeve 47 on the lower end locates within a slot 51 on the mandrel 39. Slot 51, as shown in FIG. 2*a*, is generally "L" or "J" shaped, having a vertical portion and a horizontal portion perpendicular to the axis of mandrel 39. When the pin 49 is located in the horizontal portion of slot 51, the mandrel 39 is locked to the sleeve 47. The slot 51 is formed in a collar 53 which is rigidly secured to the mandrel 39 by threads and is considered herein as part of the mandrel 39.

Referring to FIG. 3*a*, on the upper end of the sleeve 47, a locking pin 57 extends through the sleeve 47 into a vertical slot 55 formed in the mandrel 39. The locking pin 57, when located in the slot 55, prevents any relative rotation between the mandrel 39 and the sleeve 47. This prevents the pin 49 (FIG. 3*b*) from leaving the horizontal portion of the J-slot 51 and entering the vertical portion of the slot 51. This prevents the mandrel 39 from accidentally disengaging from the sleeve 47. The locking pin 57 can be retracted by pulling outward. Normally, this will be handled by a remote operated vehicle controlled from the vessel.

Referring still to FIGS. 3*a* and 3*b*, the sleeve 47 has a set of exterior left-hand threads 59. Threads 59 engage mating threads in the interior of a body 61. A pressure equalizing piston 54 is located below the threads 59, between body 61 and sleeve 47.

Body 61 has a shoulder 63 on its lower end. The shoulder 63 is adapted to land on the wellhead housing shoulder 21 (FIG. 1*a*). Body 61 has a plurality of holes 65 circumferentially spaced around it. Each hole 65 slidingly and sealingly receives one of the dogs 25. The dogs 25 can move from a retracted position, shown in FIG. 4*a*, located within the body 61, to an extended position, shown in FIG. 3*a*, protruding outward from the sidewall of the body 61.

An annular cam or shoulder 67 is formed on the sleeve 47. The cam 67 maintains the dogs 25 in the extended position when the running tool 23 is shown in the locked position of FIG. 3*a*. The cam 67 will abut against the inner end of each dog 25, preventing it from retracting. Rotating the drill pipe 29 while the locking pin 57 is still in locked position will cause the sleeve 47 to rotate with the mandrel 39. The right-hand rotation will cause the threads 59 to unscrew, causing the sleeve 47 an mandrel 39 to move axially upward relative to body 61 to the position shown in FIG. 4*a*. In the upper position, the cam 67 will contact a sealing ring 69 mounted to the body 61 above the cam 67.

Sealing ring 69 seals the upper end of body 61 to the sleeve 47. The interior space between the sleeve 47 and body 61, including the space surrounding and inward of dogs 25 and the space in the threads 59, is sealed from exterior fluids and filled with a lubricant. Piston 54 (FIG. 3*b*) equalizes the pressure of the lubricant in this interior space with the hydrostatic pressure of the sea water. Vertical passages (not shown) extend through the body 61 to allow the return of drilling fluid pumped down the drill pipe strings 29, 31.

In operation, sections of conductor pipe 17 will be screwed together at a floating vessel and lowered into the sea. Normally, the total length of the conductor pipe string 17 will be less than the depth of the sea. When the desired length of conductor pipe 17 has been reached, typically around 300 feet, it will be supported by slips on the vessel and a wellhead housing. 19 will be secured to the upper end of the conductor pipe 17. A drill bit 35 will be lowered on a drill string 31 through the conductor pipe 17. The drill pipe string 31 has a length selected to position the drill bit 35 only slightly below the lower end of the conductor pipe 17. The running tool 23 will be secured to the upper end of the drill pipe string 31.

The sleeve 47 will be secured to the wellhead housing 19 in the position shown in FIG. 3*a*, with the dogs 25 in the locked extended position. The dogs 25 will engage the grooves 27 in the wellhead housing 19. The assembly of the conductor pipe 17, drill string 31 and drill bit 35 will be lowered through the well receptacle 15 (FIG. 1*a*) into contact with the sea floor 13. This entire assembly will be lowered on the drill string 29 from the floating vessel.

Then, high pressure drilling fluid will be pumped down the drill pipe strings 29, 31 to power the drill motor 33. The motor 33 will rotate the drill bit 35. The drilling fluid is discharged out jets in the drill bit 35. The combined jetting action and the rotation of the drill bit 35 will create the well 18. Simultaneously, the drill pipe string 29 will be lowered. This allows the conductor pipe 17 to slide down into the well 18 as it is being drilled. The drill bit 35 will remain at the lower end of the conductor pipe 17 during the drilling of this initial portion of the well 18.

When the total depth of the initial portion of the well 18 is reached, the wellhead housing 19 will seat inside the well receptacle 15. This position is shown in FIG. 2*a*. Then, the drill pipe string 29 is rotated to the right a number of turns. Referring to FIG. 3*a*, the locking pin 57 causes the mandrel 39 and the sleeve 47 to rotate together. The J-slot 51 and pin 49 also lock the mandrel 39 and sleeve 47 together. The left-hand threads 59 result in the sleeve 47 and mandrel 39 moving upward relative to the body 61 of the running tool 23. When in the upper position, shown in FIG. 4*a*, the dogs 25 are free to retract. This releases the running tool 23 from the wellhead housing 19 and the drill pipe 29 could be pulled upward relative to the conductor pipe 17 at this point if desired.

However, it is preferable to continue drilling the well 18 below the conductor pipe 17. The body 61 of the running tool 23 cannot drop below the wellhead housing 19 because of the contact of the body shoulder 63 on the wellhead housing shoulder 21. A remote operated vehicle will be maneuvered from the floating vessel down to the running tool 23. It will pull the pin 57 from the slot 55. Then, the drill string 29 is rotated one-fourth turn to the right and lowered. The mandrel 39 will rotate relative to the sleeve 47. This positions the pin 49 (FIG. 3*b*) in the vertical portion of the J-slot 51. This allows the mandrel 39 to move axially downward from the running tool 23, as shown in FIG. 2*a*.

Drilling fluid is again pumped down the drill strings 29, 31 to rotate the drill bit 35. Preferably, lower pressure and flow rates for the drilling fluid are used at this point to reduce the diameter of well 18, since the well 18 will be receiving a smaller diameter of casing than conductor pipe 17. The second portion of the well 18 will be drilled possibly another 1,000 feet below the lower end of the conductor pipe 17. The diameter of the second portion of the well will typically be 26 inches, while the conductor pipe 17 diameter is typically 30 inches. Drilling fluid will flow up the well 18 and through the conductor pipe 17.

Figure 4A:
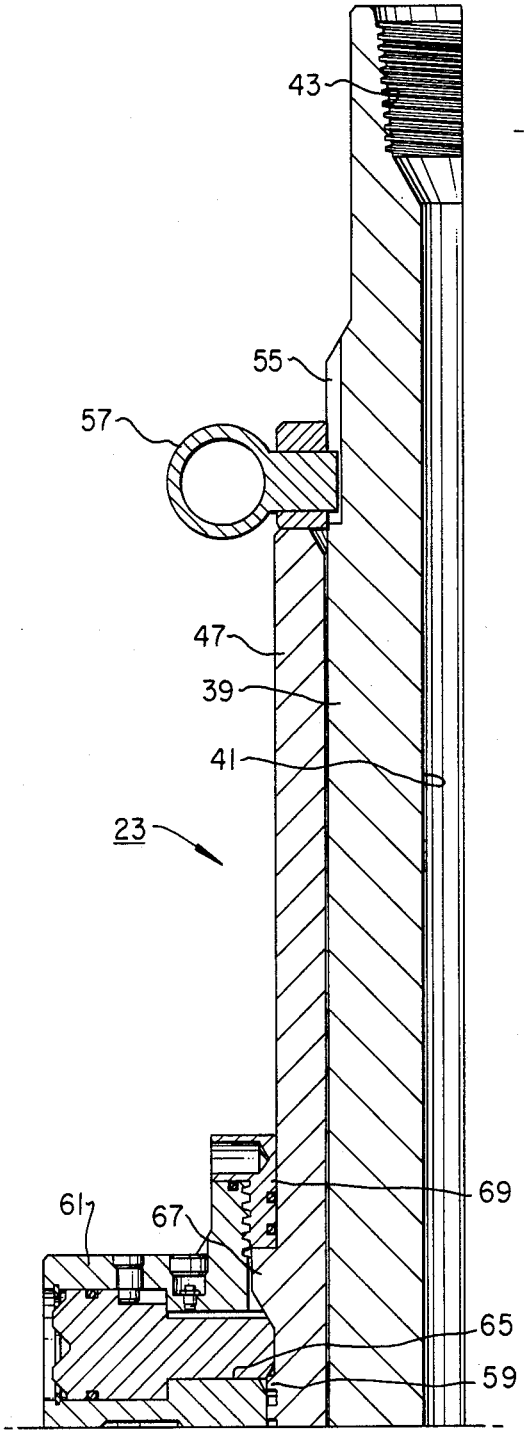
FIGS. 4*a* and 4*b* are enlarged sectional views of the running tool of FIGS. 1*a* and 1*b* showing the running tool in a released position from the wellhead housing.
Figure 4B:
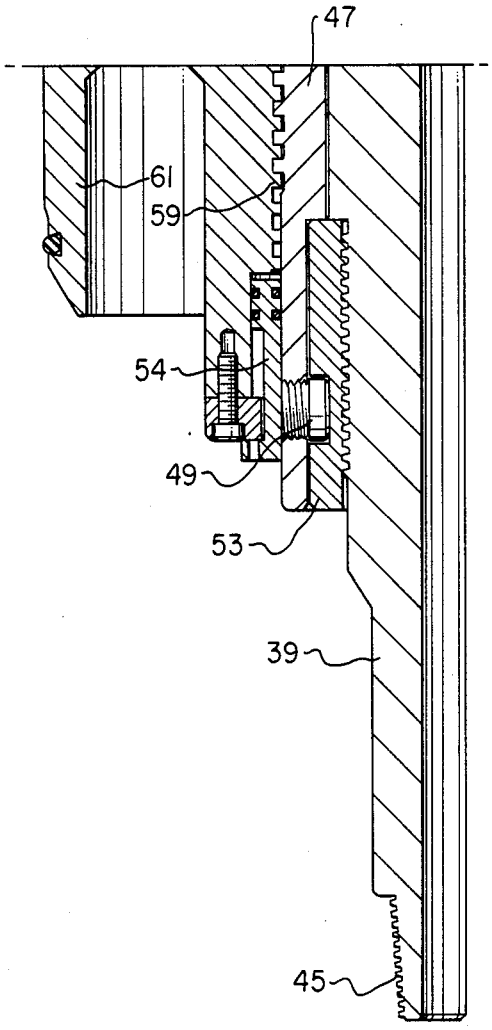

Once the second portion of the well 18 has been drilled, the operator will begin pulling the drill pipe 29, 31. Eventually the mandrel 39 will move back into contact with the sleeve 47 (FIGS. 4*a*, 4*b*). Rotation will cause the pin 49 to reenter the slot 51. The drill string 29 is again lifted, lifting the running tool 23 from the wellhead housing 19. The running tool 23 and drill bit 35 will be pulled to the surface.

A second string of casing (not shown) will be lowered from the vessel through the conductor pipe 17 and into the second portion of the well 18. The second string of casing, typically about 20 inches in diameter, will be cemented in place. Drilling of the well to a greater depth will then continue.

The invention has significant advantages. The running tool allows the operator to drill out from the conductor pipe without making a trip back to the surface. The cam actuated dogs can be released without difficulty even in floating vessels which are subject to wave action. The locking pin assures that the mandrel does not release from the running tool accidentally.

While the invention has been shown in only one of its forms, it should be apparent to those skilled in the art that it is not so limited, but is susceptible to various changes without departing from the scope of the invention.

We claim:

1. An apparatus for drilling first and second portions of a subsea well from a floating vessel, comprising in combination:

a string of conductor pipe having a wellhead housing on its upper end, the conductor pipe adapted to be lowered from the vessel into the well as the first portion is being drilled;

a string of drill pipe adapted to be lowered from the vessel through the conductor pipe;

a drilling tool mounted to the lower end of the drill pipe for drilling the first and second portions of the well;

a tubular mandrel having upper and lower threaded ends for connection into the string of drill pipe, the mandrel having an axial passage for the passage of drilling fluid;

a sleeve having a bore for receiving the mandrel;

a body having a bore for receiving the sleeve, the body adapted to seat inside the wellhead housing;

a plurality of dogs carried by the body and being movable between an extended position protruding from the body for engaging a groove formed in the wellhead housing to lock the body to the wellhead housing during drilling of the first portion and a retracted position for releasing the body from the wellhead housing to remove the drill pipe after the second portion has been drilled:

means cooperating between the sleeve and the body for moving the dogs from the extended position to the retracted position upon a selected releasing movement of the sleeve relative to the body; and means cooperating between the mandrel and the sleeve for securing the mandrel to the sleeve to maintain the drilling tool at the lower end of the conductor pipe during insertion of the conductor pipe into the well while drilling the first portion, and for releasing the mandrel from the sleeve to allow the drilling tool to move downward from the conductor pipe to drill the second portion after the conductor pipe has reached the desired depth.

2. An apparatus for drilling first and second portions of a subsea well from a floating vessel, comprising in combination:

a string of conductor pipe having a wellhead housing on its upper end, the conductor pipe adapted to be lowered from the vessel into the well as the first portion is being drilled;

a string of drill pipe adapted to be lowered from the vessel through the conductor pipe;

drill motor means mounted to the lower end of the drill pipe for rotating a drill bit relative to the drill pipe in response to drilling fluid pumped down the drill pipe, to drill the first and second portions of the well;

a tubular mandrel having upper and lower threaded ends for connection into the string of drill pipe, the mandrel having an axial passage for the passage of drilling fluid;

a sleeve having a bore for receiving the mandrel and having a set of external threads;

a body having a bore for receiving the sleeve, the body adapted to seat inside the wellhead housing, the body having a set of internal threads for engaging the external threads of the sleeve;

a plurality of dogs carried by the body and being movable between an extended position protruding from the body for engaging a groove formed in the wellhead housing to lock the body to the wellhead housing during drilling of the first portion and a retracted position for releasing the body from the wellhead housing to remove the drill pipe after the second portion has been drilled;

cam means located on the exterior of the sleeve for maintaining the dogs in the extended position and for disengaging from the dogs to allow them to retract when the sleeve is rotated relative to the body, the engagement of the threads of the sleeve and the body causing the sleeve to move axially when the sleeve is rotated relative to the body; and means cooperating between the mandrel and the sleeve for securing the mandrel to the sleeve to maintain the drill bit at the lower end of the conductor pipe during insertion of the conductor pipe into the well while drilling the first portion, for causing the sleeve to rotate with the mandrel and drill pipe to disengage the dogs from the wellhead housing, and for releasing the mandrel from the sleeve to allow the drill bit to move downward from the conductor pipe to drill the second portion after the conductor pipe has reached the desired depth.

3. In an apparatus for drilling first and second portions of a subsea well from a floating- vessel, including a string of conductor pipe having a wellhead housing on its upper end, the conductor pipe adapted to be lowered from the vessel into the well as the first portion is being drilled, a string of drill pipe adapted to be lowered from the vessel through the conductor pipe, drill motor means mounted to the lower end of the drill pipe for rotating a drill bit in response to drilling fluid pumped down the drill pipe to drill the first and second portions of the well, the improvement comprising:

a tubular mandrel having upper and lower threaded ends for connection into the string of drill pipe, the mandrel having an axial passage for the passage of drilling fluid;

a sleeve having a bore for receiving the mandrel and having a set of external threads;

a body having a bore for receiving the sleeve, the body adapted to seat inside the wellhead housing, the body having a set of internal threads for engaging the external threads of the sleeve;

a plurality of dogs carried by the body and being movable between an extended position protruding from the body for engaging a groove formed in the wellhead housing to lock the body to the wellhead housing during drilling of the first portion, and a retracted position for releasing the body from the wellhead housing to remove the drill pipe after the second portion has been drilled;

cam means located on the exterior of the sleeve for maintaining the dogs in the extended position and for disengaging from the dogs to allow them to retract when the sleeve is rotated relative to the body, the engagement of the threads of the sleeve and the body causing the sleeve to move axially when the sleeve is rotated relative to the body;

guide slot means cooperating between the mandrel and the sleeve including a guide slot and a pin for selectively securing the mandrel to the sleeve to maintain the drill bit at the lower end of the conductor pipe during insertion of the conductor pipe into the well while drilling the first portion, to selectively rotate the sleeve with the mandrel and drill pipe to release the dogs, and for selectively releasing the mandrel from the sleeve by rotating the drill pipe relative to the sleeve to allow the drill bit to move downward from the conductor pipe to drill the second portion after the conductor pipe has reached the desired depth; and locking means for selectively preventing rotation of the mandrel relative to the sleeve to prevent the guide slot means from accidentally releasing the mandrel from the sleeve while drilling the first part of the well.

* * * * *

UNITED STATES PATENT OFFICE

CERTIFICATE OF CORRECTION

Patent No. 4,813,496 Dated 3/21/89

Inventor(s) David J. Rohweller, et al

It is certified that error appears in the above-identified patent and that said Letters Patent is hereby corrected as shown below:

Column 3, Line 40, "an" is changed to --and;
Column 3, Line 60, the period is deleted.

Signed and Sealed this

Seventeenth Day of April, 1990

*Attest:*

HARRY F. MANBECK, JR.

*Attesting Officer*

*Commissioner of Patents and Trademarks*